US006559737B1

(12) United States Patent
Nagra et al.

(10) Patent No.: US 6,559,737 B1
(45) Date of Patent: May 6, 2003

(54) PHASE SHIFTERS USING TRANSMISSION LINES PERIODICALLY LOADED WITH BARIUM STRONTIUM TITANATE (BST) CAPACITORS

(75) Inventors: Amit S. Nagra, Santa Barbara, CA (US); Robert A. York, Santa Barbara, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/721,435

(22) Filed: Nov. 22, 2000

Related U.S. Application Data

(60) Provisional application No. 60/167,469, filed on Nov. 24, 1999.

(51) Int. Cl.[7] ..... H01P 9/00

(52) U.S. Cl. ..... 333/156; 333/161

(58) Field of Search ..... 333/156, 161, 333/164, 138

(56) References Cited

U.S. PATENT DOCUMENTS

| | | | | |
|---|---|---|---|---|
| 5,237,629 A | * | 8/1993 | Hietala et al. | 333/138 |
| 5,355,104 A | | 10/1994 | Wolfson et al. | 333/161 |
| 5,472,935 A | | 12/1995 | Yandrofski et al. | 505/210 |
| 5,557,286 A | | 9/1996 | Varadan et al. | 343/700 MS |
| 5,589,845 A | | 12/1996 | Yandrofski et al. | 343/909 |
| 5,619,061 A | | 4/1997 | Goldsmith et al. | 257/528 |
| 5,644,598 A | | 7/1997 | Bidese | 375/258 |
| 5,721,194 A | * | 2/1998 | Yandrofski et al. | 333/24 C |
| 5,790,367 A | * | 8/1998 | Mateika et al. | 361/321.4 |
| 5,903,178 A | | 5/1999 | Miyatsuji et al. | 327/308 |
| 6,277,436 B1 | * | 8/2001 | Stauf et al. | 219/121.68 |
| 6,372,286 B1 | * | 4/2002 | Azuma et al. | 427/226 |
| 6,380,608 B1 | * | 4/2002 | Bentley | 257/3 |
| 6,396,338 B1 | * | 5/2002 | Huang et al. | 329/303 |
| 6,400,237 B1 | * | 6/2002 | Seino | 333/139 |

OTHER PUBLICATIONS

F. Abbas, I.E. Davis, and J.C. Gallop, "A Distributed Ferroelectric Superconducting Transmission–Line Phase Shifter," in 1996 IEEE MTT–S International Microwave Symposium Digest Catalog No. 96CH35915, San Francisco, CA, USA, 1996, vol. 3, pp. 1671–1674.

F. Abbas, J.C. Gallop, and C.D. Langham, "Microwave Ferroelectric Superconducting Phase Shifter," in 27th European Microwave 97 Conference and Exhibition, Bridging the Gap Between Industry and Academia. Conference Proceedings IEEE Catalog No. 97TH8317, Jerusalem, Israel, 1997, vol. 1, pp. 518–522.

(List continued on next page.)

*Primary Examiner*—Robert Pascal
*Assistant Examiner*—Kimberly Glenn
(74) *Attorney, Agent, or Firm*—John P. O'Banion

(57) ABSTRACT

A phase shifter, such as for use in phased antenna arrays, comprising thin film BST capacitors periodically loading a transmission line. The BST thin films can be deposited using RF sputtering on a variety of substrates, and the capacitors can be of a parallel plate configuration or of an interdigitated configuration. An aspect of the invention additionally provides for the use of periodically distributed lumped-element inductors comprising the transmission line. A further aspect provides for programmatic determination of circuit design and configuration parameters based on the input of desired characteristics and materials for the phase shifter.

24 Claims, 6 Drawing Sheets

OTHER PUBLICATIONS

F. De Flaviis and N.G. Alexopoulos, "Low Loss Ferroelectric Based Phase Shifter for High Power Antenna Scan Beam System," in IEEE Antennas and Propagation Society International Symposium 1997. Digest Catalog No. 97CH36122, Montreal, Quebec, Canada, 1997, vol. 1, pp. 316–319.

F. De Flaviss, N.G. Alexopoulos, and O.M. Stafsudd, "Planar Microwave Integrated Phase–Shifter Design with High Purity Ferroelectric Material," IEEE Transactions on Microwave Theory and Techniques,Jun., 1997, vol. 45, pp. 963–969.

R.G. Geyer, J. Krupka, L. Sengupta, and S. Sengupta, "Microwave Properties of Composite Ceramic Phase Shifter Materials," in ISAF '96. Proceedings of the Tenth IEEE International Symposium on Applications of Ferroelectrics Catalog No. 96CH35948, East Brunswick, NJ, USA, 1996, vol. 2, pp. 851–854.

C.M. Jackson, T. Pham, Z. Zhang, A. Lee, and C. Pettiete–Hall, Model for a Novel CPN Phase Shifter, in 1995 IEEE MTT–S International Microwave Symposium Digest Catalog No. 95CH3577–4, Orlando, FL, USA, 1995, vol. 3, pp. 1439–1442.

S.V. Orlov, "A Ferroelectric Film microstrip Phase–Shifter," Izvestiya Vysshikh Uchebnykh Zavedenii, Radioelektronika, 1988, vol. 31, pp. 86–87.

* cited by examiner

PHASE SHIFTERS USING TRANSMISSION LINES PERIODICALLY LOADED WITH BARIUM STRONTIUM TITANATE (BST) CAPACITORS

CROSS-REFERENCE TO RELATED APPLICATIONS

This application claims priority from U.S. provisional application Ser. No. 60/167,469 filed on Nov. 24, 1999, which is incorporated herein by reference.

STATEMENT REGARDING FEDERALLY SPONSORED RESEARCH OR DEVELOPMENT

This invention was made with Government support under Grant No. DABT 63-98-1-0006, awarded by the Department of the Army. The Government has certain rights in this invention.

REFERENCE TO A MICROFICHE APPENDIX

Not Applicable

BACKGROUND OF THE INVENTION

1. Field of the Invention

This invention pertains generally to phased antenna arrays, and more particularly to techniques for loading a associated transmission line to create a phased array.

2. Description of the Background Art

Phased array antennas are used in a number of applications, including both terrestrial and airborne radar, and satellite and mobile communications, where fast beam scanning is required or where mechanical rotation of the antenna is not practical and/or desirable. Antenna arrays typically comprise several radiating elements, each having a dedicated phase shifter. By adjusting the phase shifts for each of the individual radiators, it is possible to control the direction of the composite main beam.

There are several benefits to phase antenna arrays. For example, since the phase shifters are usually controlled electronically, the direction of the antenna main beam can be scanned very rapidly in comparison with a mechanically rotated antenna. In addition, a phased array requires no moving parts and can be constructed as a planar or conformal structure. A disadvantage of using a phased array, however, is that that each radiating element requires its own phase shifter, and high performance phase shifters that are currently available are expensive. In fact, the cost of the phase shifters can be as high as 40% of the total cost of the phased array.

Phased array antenna systems typically employ ferrite phase shifters or semiconductor device phase shifters. Ferrite phase shifters are typically difficult to manufacture, however, and hence tend to be expensive. Another disadvantage to the use of ferrite phase shifters is that they are exceedingly slow to respond to control signals, thus making them unsuitable for use in applications requiring rapid beam scanning. On the other hand, faster response can be achieved by utilizing semiconductor device phase shifters, but semiconductor phase shifters tend to suffer from high losses at microwave and millimeter wave frequencies, and have limited power-handling capability.

In an effort to overcome the aforementioned problems, fully distributed phase shifter circuits using Barium Strontium Titanate (BST), which is a ferroelectric material, have been investigated. In these circuits, the BST material is used to fabricate the entire microwave substrate on which the conductors are deposited in the form of thick films or bulk crystals, or to fabricate a portion of the substrate in the form of thin films sandwiched between substrate and conductors. These circuits rely on the principle that, since part or all of the microwave fields pass through the ferroelectric layer, the phase velocity of the waves propagating on these structures can be altered by changing the permittivity of the ferroelectric layer. This approach has several limitations, however, including: (1) the amount of capacitive loading due to the ferroelectric film cannot be easily varied to optimize phase shifter performance; (2) conductor losses are high in this structure due to the high dielectric constant of the ferroelectric film on which the transmission lines are fabricated; (3) the tunability of the film is not efficiently utilized; and (4) the control voltages required for this approach tend to be very high.

Therefore, a need exists for a phase shifting transmission line technology that addresses the aforementioned problems. The present invention satisfies that need, as well as others, and overcomes the deficiencies found in current techniques.

BRIEF SUMMARY OF THE INVENTION

The present invention addresses the need for a new technology capable of loading transmission lines with BST capacitors, and is a significant departure from the continuous fully distributed techniques outlined above. In general terms, the invention comprises a low cost phase shifter circuit intended for use in phased array systems of the type described above. The invention further comprises a method of deploying BST capacitors to load the transmission line which addresses the shortcomings of present solutions. According to one aspect of the invention, lumped-element inductors are periodically connected in series as part of the phase-shifting transmission line. In accordance with another aspect of the invention, a program is described for determining circuit configuration and parameters for phase shifters according to the present invention.

By way of example, and not of limitation, a phase shifter according to the present invention employs thin film BST capacitors for periodically loading the transmission line as opposed to conventional continuous loading. The BST thin films can be deposited using RF sputtering, which is less expensive in comparison with semiconductor epitaxy. Moreover, the BST thin film phase shifter circuits may be manufactured using the high volume, low cost monolithic fabrication techniques developed by the IC industry. These aspects of the invention allow the creation of phase shifters at a fraction of the cost of currently available ferrite/semiconductor phase shifters.

Characterization of RF sputter deposited BST films at microwave frequencies has confirmed that it is possible to make phase shifters with extremely low losses at microwave/millimeter wave frequencies. In addition, these circuits are characterized by low drive power requirements, fast switching speeds, and high power handling capability. The aforementioned benefits make this technology extremely attractive for the manufacture of phased array antennas. Availability of the low cost phase shifters according to the present invention are expected to drive down the cost of phased array antennas and increase their acceptance in both military and civilian applications.

When designed according to the present invention, a phase shifter structure so behaves as a synthetic transmission line whose phase velocity can be controlled by properly configuring the values of external loading capacitors. This topology utilizes the tunability of the BST film effectively, thus requiring reduced control voltage levels. The use of periodic loading along the transmission line allows the structure to be optimized for improved loss performance. Furthermore, since the transmission lines are fabricated on low dielectric constant substrates, the conductor losses are reduced.

An object of the invention is to provide a low cost phase shifter circuit for use in phased array systems.

Another object of the invention is to use BST capacitors for periodically loading transmission lines.

Another object of the invention is to provide phase-shifter transmission line inductance by utilizing lumped-element inductors periodically placed in series along the transmission line.

Another object of the invention is to provide BST thin film phase shifter circuits that are inexpensive and which can be manufactured using the high volume, low cost monolithic fabrication techniques developed by the IC industry.

Another object of the invention is to provide phase shifters with extremely low losses at microwave/millimeter wave frequencies.

Another object of the invention is to provide phase shifters that exhibit low drive power requirements, fast switching speeds, and high power handling capability.

Another object of the invention is to provide a phase shifter structure that behaves as a synthetic transmission line whose phase velocity can be controlled by changing the value of the external loading capacitors.

Another object of the invention is to provide a tunable phase shifter that requires low control voltages.

Another object of the invention is to provide transmission lines that are fabricated on low dielectric constant substrates and which have low conductor losses.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is described with reference to FIG. 1 through FIG. 8. It will be appreciated that the apparatus may vary as to configuration and as to details of the parts, and that the method may vary as to the specific steps and sequence, without departing from the basic concepts as disclosed herein.

Figure 1A:
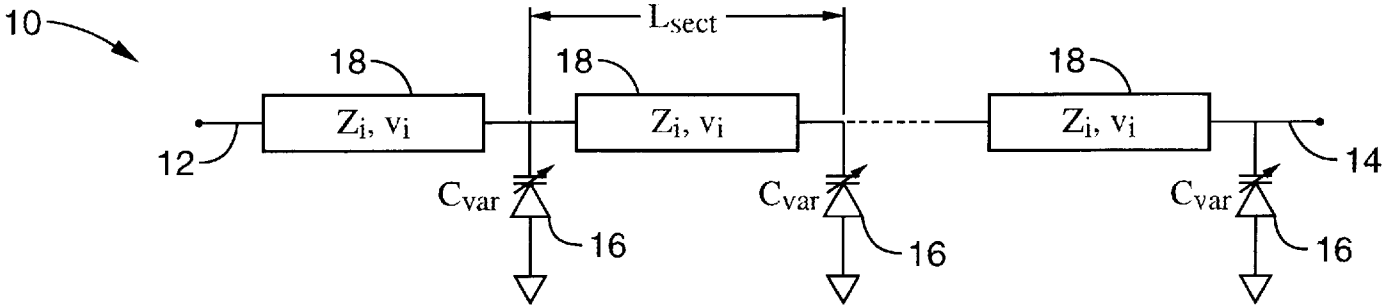
FIG. 1A is a schematic diagram of a periodically loaded line phase shifter according to an embodiment of the present invention.

Referring first to FIG. 1A, a periodically loaded phase shifter 10 according to the present invention is shown schematically. In the embodiment of FIG. 1A, the invention comprises a high impedance transmission line with an input 12 and an output 14, between which are periodically positioned thin film Barium Strontium Titanate (BST) capacitors 16 with spacing $L_{sect}$ that divide the transmission line into transmission line segments 18.

Figure 1B:
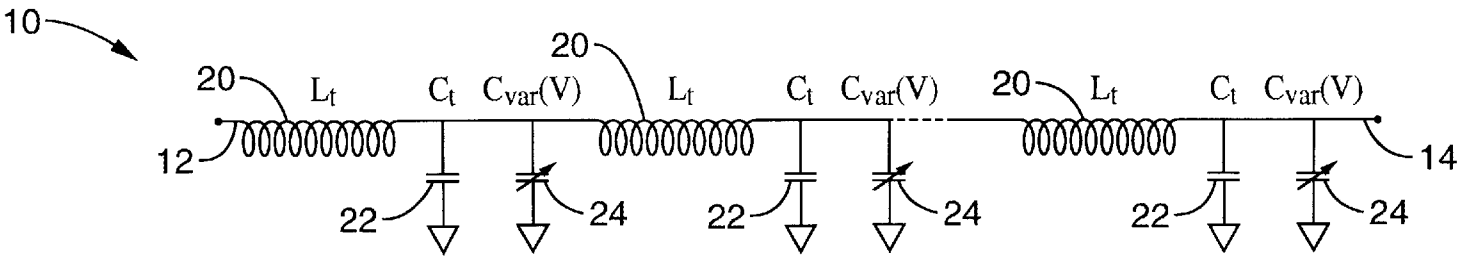
FIG. 1B is a schematic diagram of an equivalent circuit model for the periodically loaded line represented in FIG. 1A.

For frequencies significantly less than the Bragg frequency, this structure behaves as a synthetic transmission line having an equivalent circuit as shown in FIG. 1B. It will be appreciated that the properties of a transmission line depend on the inductance per unit length, represented as a series of inductors $L_t$ 20, and the total capacitance per unit length, represented as coupled pairs of capacitors $C_t$ 22 and $C_{var}(V)$ 24. $C_t$ 22 provides a fixed component of capacitance, and $C_{var}(V)$ 24 provides a variable component of capacitance that depends on bias voltage. It will be appreciated that the inductance remains unchanged from that of an unloaded line while the total capacitance is altered due to loading by BST capacitors. Therefore, the impedance and the propagation velocity of the resulting synthetic transmission line are functions of the loading provided by the BST capacitors. Since the capacitance of the BST capacitors is dependent upon the applied bias, the resultant loaded transmission line has a phase velocity that may be varied in response to the applied bias voltage.

Figure 1C:
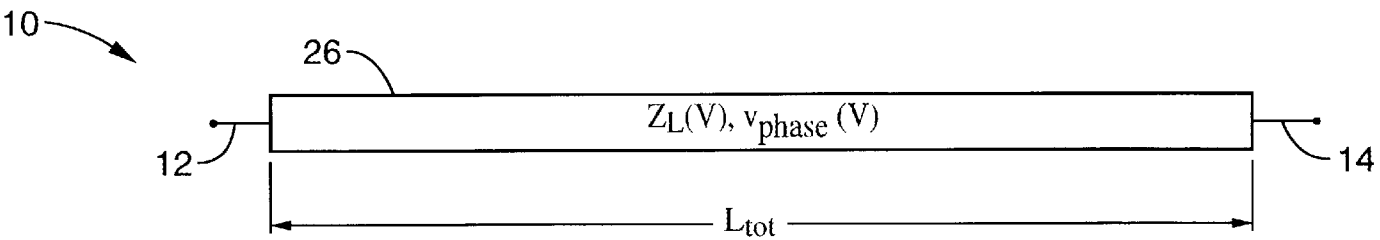
FIG. 1C is a diagram of a synthetic transmission line corresponding to the equivalent circuit of FIG. 1B.

In FIG. 1C, the periodically loaded phase shifter 10 thus described is further represented as a synthetic line 26 of length $L_{tot}$. The equations that govern the behavior of the synthetic line depicted in FIG. 1C are given by:

$$Z_L(V) = \sqrt{\frac{L_t}{C_t + C_{\text{var}}(}} \quad (1)$$

$$v_{phase}(V) = \frac{1}{\sqrt{L_t(C_t + C_{\text{var}}(\ )}} \quad (2)$$

where $Z_L$ is the characteristic impedance of the resulting synthetic transmission line and $V_{phase}$ is the phase velocity along the synthetic transmission line. Inductance and capacitance per section due to the unloaded line by itself are given by $L_t$ and $C_t$, respectively, while $C_{var}(V)$ is the externally added loading capacitor (function of bias V) per section. An important observation is that the characteristic impedance is also a function of the applied bias voltage. Therefore, matching problems may arise which are exhibited in response to bias voltage changes. However, circuit design techniques make it possible to minimize the change in the characteristic impedance in response to bias voltage changes. Achieving a final circuit design is simplified by utilizing a computer-implemented method that will be described later.

Figure 2:
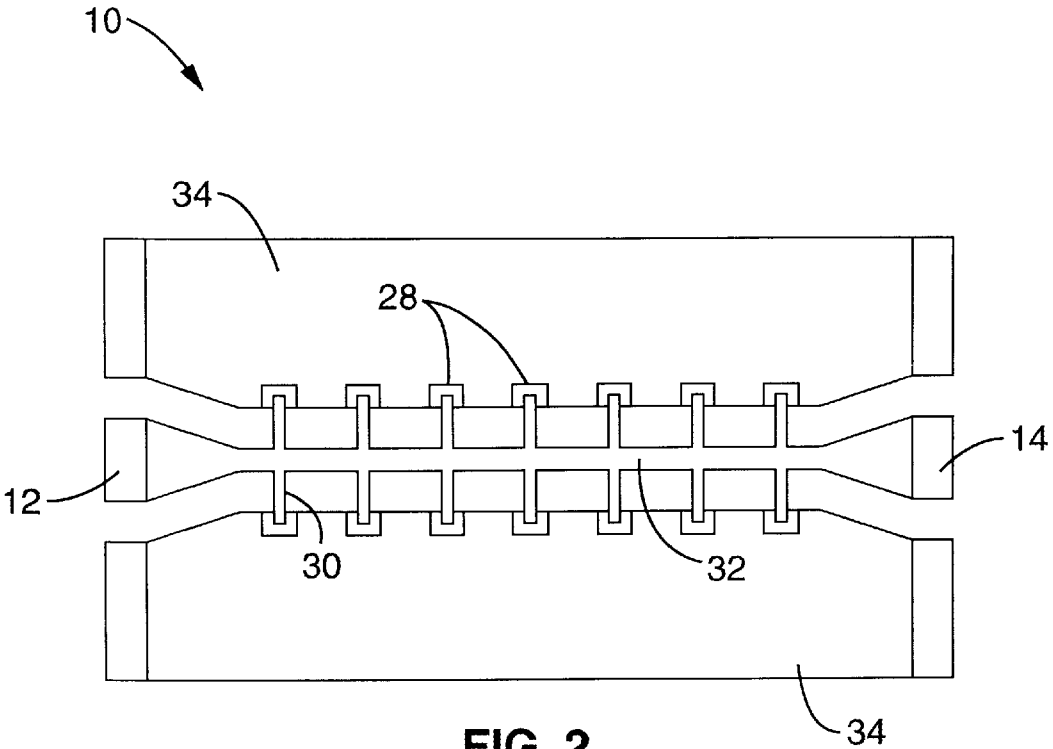
FIG. 2 is a schematic plan view of an embodiment of a phase shifter according to the present invention shown with a coplanar waveguide (CPW) line periodically loaded with thin film BST capacitors.

Referring now to FIG. 2, a traveling wave implementation of the periodically loaded capacitor phase shifter 10 is shown. This embodiment of the present invention may be implemented in a variety of ways, which include the use of coplanar waveguide (CPW) or microstrip lines. FIG. 2 shows the coplanar waveguide implementation, having loading capacitors 28 connected with shunt segments 30 between a center conductor 32 and a ground plane 34. The coplanar waveguide implementation of FIG. 2 is easily manufactured and does not require the use of "via" holes which are necessary within a microstrip implementation.

An important aspect of using thin film ferroelectric (BST) phase shifters according to the invention is that, since the BST films can be grown/deposited over a variety of materials, a choice of microwave substrates exists from which to choose. This flexibility allows the circuit designer to select an appropriate substrate which matches the chosen transmission line technology and desired design parameters which, for example, include material cost, circuit loss minimization, or the ability to integrate with external circuits. The following substrates, for example, may be utilized to reduce microwave losses: high resistivity silicon, semi-insulating gallium arsenide, alumina, glass, sapphire and magnesium oxide. The invention has been practiced using several of these substrates with BST being deposited by RF sputtering. It will be appreciated, therefore, that the invention may be practiced with any form of substrate consistent with the chosen application.

The BST thin film capacitors may be fabricated by a variety of processes and may be constructed in a parallel plate configuration or in an interdigitated structure. Interdigitated capacitors are generally considered to be easier to fabricate, but exhibit a lower capacitance tuning range while requiring higher tuning voltages. Parallel plate capacitors allow the use of lower tuning voltages and larger capacitance tuning ranges, but are generally considered to be more difficult to fabricate, while providing lower quality factors than interdigitated capacitors. It will be appreciated that each capacitor topology provides both benefits and detractors for its utilization within the present invention. The above examples illustrate that the choice of capacitor topology is a choice that should be based on tradeoffs relating to the application specific requirements.

Figure 3:
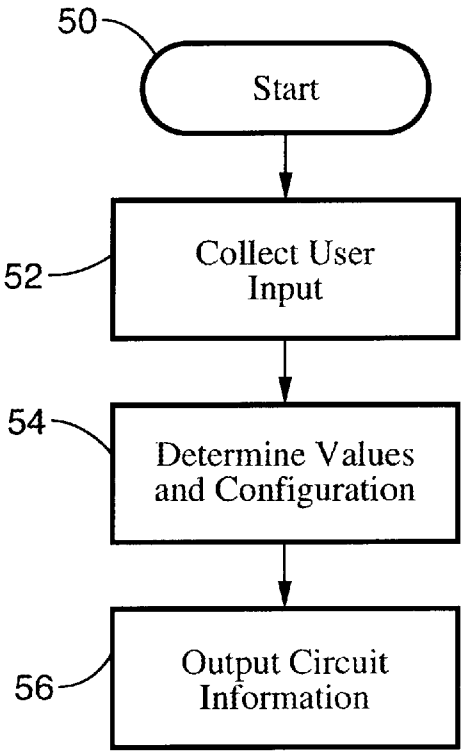
FIG. 3 is a flowchart of a method to facilitate the designing of periodically loaded phase shifters according to the present invention.

Referring to FIG. 3, a flowchart is shown of a computer program that was created to facilitate the rapid design of periodically loaded phase shifters. After entering the program at block 50, input data is collected at block 52, from which a periodically loaded line phase shifter is then designed and analyzed by the program at block 54. Program inputs include desired operating frequency, desired phase shift at the operating frequency, dielectric constant of the substrate and loss tangents of the BST film at the operating frequency. The program determines numerous relevant circuit details, such as the impedance of the interconnecting line, required conductor width, conductor spacing, values of the discrete elements (loading capacitors and/or series lumped-element inductors, spacing between discrete elements, and the total length of the traveling wave phase shifter. The program then analyzes the design and estimates the total circuit loss including conductor loss on the transmission lines and loss in the ferroelectric capacitors. The program outputs the design information at block 56 at the conclusion of the program. The program is capable of providing design guidelines for employing periodically loaded BST capacitors along a conventional strip transmission line phase-shifter, as well as the lumped-element inductors. A circuit designer utilizing the program may thereby try variations with regard to materials and design features and iteratively consider alternatives for a given application. It will be appreciated that the functions and calculations performed within the program may be implemented on a variety of computers. A detailed pseudo-code description of an embodiment of the program is provided below, showing the initialization sections, data input, data constants, calculations, analysis and data output for the sample input.

```
Clear [x, er, v, eff, numsect, z1, cvar0, tau, lentot,
totlossdiode, f, fact, mean, prop1, prop2]
Clear [z0, rho, mu, lm, er, f, w, d, h, t, eff, rf, k, K,
kprime, Kp, alphas, alphacpw, totlosscpw, totlossckt]
Clear [rs, g, lossdiodesect]
(********************* Enter Data *********************)
(* desired char impedance of the artificial line *)
z0 = 50;
(* max frequency of interest, in Hz *)
fmax = 40×10^9;
(* max phase shift desired at fmax *)
dphi = 90/180;
(* relative dielectric constant of the substrate *)
er = 5;
(* diode cut-off frequency *)
fcdiode = 10fmax;
(* ratio of Bragg freq. to fmax *)
n = 2.0;
(* ratio of cmin to cmax *)
ymin = 1/2.2;
(********************* Constants *********************)
wmax = 2 fmax;
ymax =1;
(* effective er for a cpw line *)
eff = (er + 1)/2;
(* effective velocity for a cpw line *)
```

$$v = (3\times10^8)/\sqrt{\text{eff}};$$

$$\text{mean} = \sqrt{(\sqrt{1+\text{xymax}})\times(\sqrt{1+\text{xymin}})};$$

```
(* char impedance of intermediate line *)
z1 = z0mean;
(* time of flight on the intermediate line *)
```

$$\text{tau} = 1/(n\pi\text{fmax}\sqrt{1+\text{xymax}});$$

-continued

```
(* length of each sect in meters *)
1sect = tau v;
(* zero bias cap (cmax) to be inserted in every section *)
cvar0 = xtau/z1;
(* equivalent conductance *)
g = (2 fmax cvar0) (fmax/fcdiode);
(********************** Exact Analysis **********************)
prop1 = ArcCos[Cos[2 fmax 1sect/v] - (2 fmax z1
    cvar0/2)Sin[2 fmax 1sect/v] ];
prop2 = ArcCos[Cos[2 fmax 1sect/v] - (2 fmax z1 cvar0
    ymin/2)Sin[2 fmax 1sect/v] ];
numsect = dphi/(prop1 - prop2);
(* total length of circuit in mm *)
lentot = 1sect numsect 10^3;
lossdiodesect = (g z1 Sin[2 fmax 1sect/v])/2 Sin[prop1];
totlossdiode = 8.686 lossdiodesect numsect;
(********************** CPW Losses **********************)
(* resistivity of metal used in CPW compared to copper *)
fact = 1.7
(* ohm.cm *)
rho = fact 1.72/10^6;
(* H/cm *)
mu = 4/10^9;
```

$$zI0 = z1\sqrt{eff};$$

```
(* ratio of center cond width to ground separation *)
k = Tahn [(377/8 zI0) - (log [2]/2)]^2;
d = (1sect 10^3)/1.5;
(* ground separation (mm) chosen as fraction of section length
to reduce parasitics *)
(* center conductor width (mm) *)
W = kd;
(* substrate thickness (mm) *)
h = 400/10^3;
(* CPW metal thickness (mm) *)
t = 1.2/10^3;
(* skin depth in cm *)
```

$$tand = \sqrt{\frac{rho}{\pi \times fmax \times mu}};$$

```
(* ratio of thickness to skin depth in same units *)
ratio = t/(10 tand);
(* freq. mod factors *)
mod = ½ (Exp[ratio] - Cos[ratio] + Sin[ratio])/
    (Cosh[ratio] - Cos[ratio] - Cos[ratio]);
(* ohms *)
```

$$rf = \sqrt{\pi \times fmax \times mu \times rho};$$

K = EllipticK[k];

$$kprime = \sqrt{1 - k^2};$$

Kp = EllipticK[kprime];

$$alphas = \frac{(8.686 \times rf \times \sqrt{eff})\left(\frac{2\left(\pi + Log\left[\frac{4\pi \times W(1-k)}{t(1+k)}\right]\right)}{k} + \frac{2\pi + 2Log\left[\frac{4\pi \times d(1-k)}{t(1+k)}\right]}{0.4 \times 377dKKp(1-k^2)}\right)}{} \times (1/10);$$

```
    (* (1/10) converts cpw metal losses in dB/mm *)
(* corrected CPW losses in db/mm *)
alphacpw = (z1/z0) (alphas) (mod);
(* total CPW losses *)
totlosscpw = lentot (alphacpw);
(* total circuit loss *)
totlossckt = totlossdiode + totlosscpw;
```

-continued

Figure 4B:
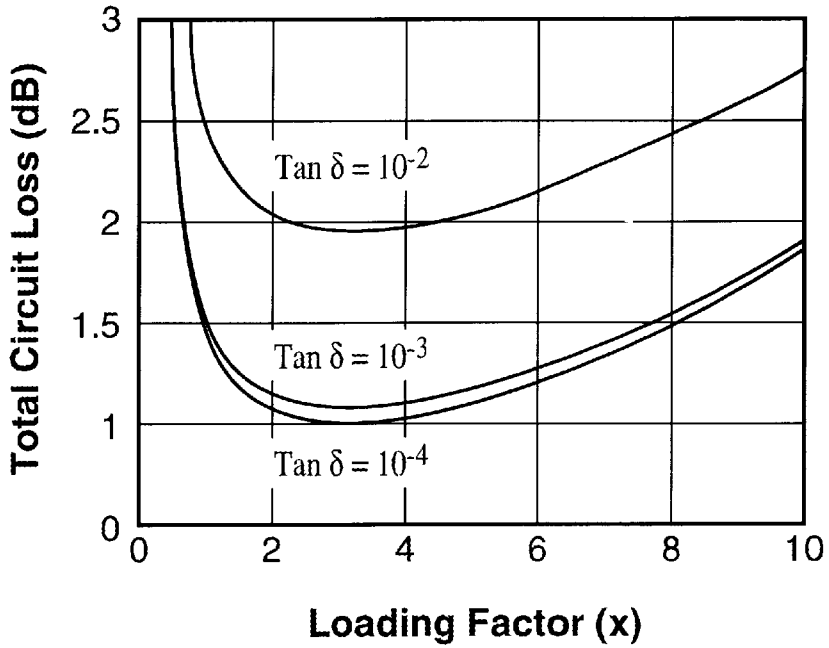
FIG. 4B is a graph of calculated loss curves showing total loss for a 360° phase shifter at 10 GHz in accordance with the present invention shown as a function of BST loss tangent.
Figure 4A:
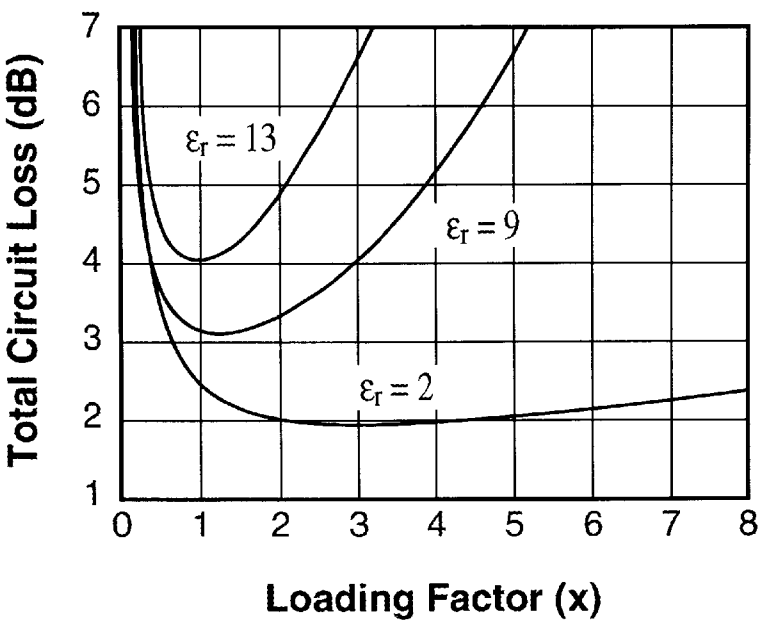
FIG. 4A is a graph of calculated loss curves showing total loss for a 360° phase shifter at 10 GHz in accordance with the present invention shown as a function of substrate dielectric constant.
Figure 5:
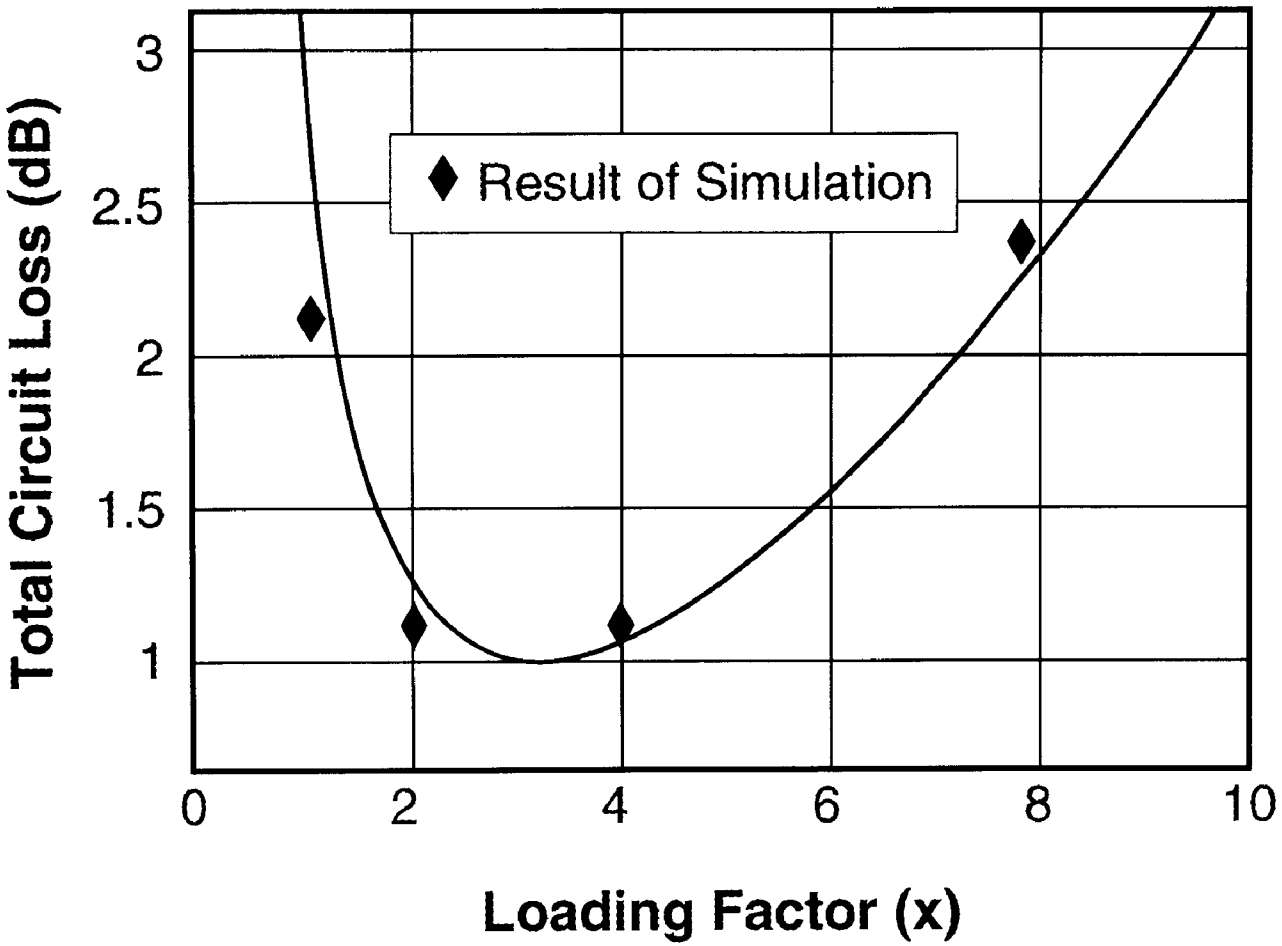
FIG. 5 is a graph of design curves using simulations according to the present invention shown as results for circuits with different loading factors 'x' with substrate effective dielectric constant $\in_r=2$ and BST tan $\delta=10^{-2}$ at 10 GHz.

```
a1 = Plot[totlossckt, {x, 0.2, 8}]
[Graph Output omitted - see FIG. 4A]
FindMinimum[totlossckt, {(x, 0.5}]
{2.47305, {x 3.40888}}
x = 3.4;
N[z1]
91.4691
N[cvar0]
7.0508 × 10^-14
N[1sect × 10^3]
0.328545
N[numsect]
6.03831
N[lentot]
1.98386
N[w]
0.0611504
N[d]
0.21903
```

Note that one of the important variables in analyzing periodically loaded transmission lines is the loading factor 'x' which is the ratio of the external loading capacitor to the unloaded line capacitance:

$$x = \frac{va}{} \tag{3}$$

FIG. 4A and FIG. 4B indicate that a certain optimum loading factor exists for minimizing the total circuit loss. The optimum loading value, as shown in FIG. 4A, is different for substrates with different dielectric constants $\in_r$. Another important observation is that the total circuit loss decreases with a decrease in the substrate dielectric constant. Since the invention allows a range of substrates to choose from, it is possible to exploit this property to fabricate phase shifters with really low insertion loss on low dielectric constant substrates, such as glass. FIG. 4B shows the effect of BST thin film loss tangents on the total phase shifter losses. An effective dielectric constant $\in_r$=2 for the substrate was assumed within these calculations. It can be seen that the total circuit losses decrease with lower loss tangents until a certain threshold is reached beyond which circuit loss becomes relatively insensitive to further lowering of the loss tangent. At the threshold point, the circuit losses are dominated by the conductor losses and preliminary calculations show that loss tangents of $10^{-3}$ (specified at 10 GHz) are sufficient to be in a conductor loss limited regime. Loss tangents as low as $10^{-2}$ have been achieved during testing of the present invention which was implemented utilizing RF sputter deposited BST.

Figure 6A:
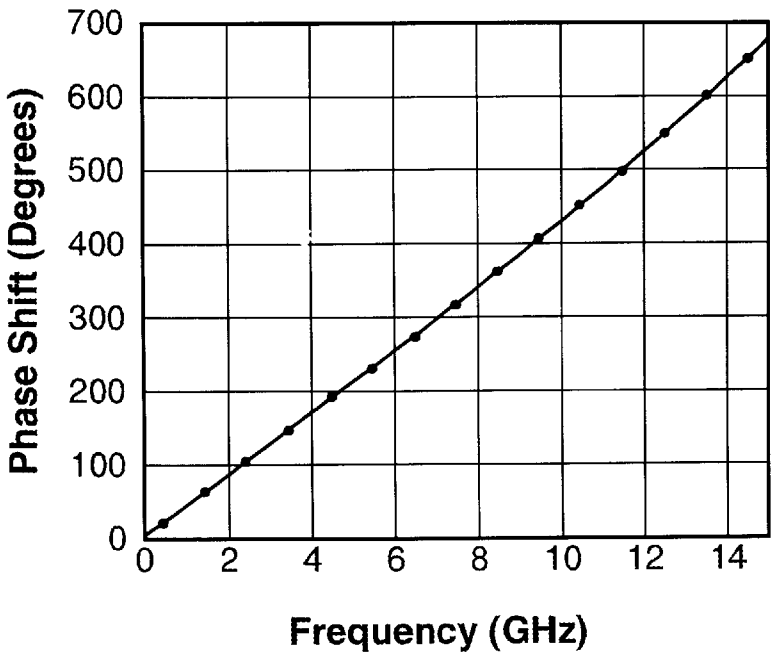
FIG. 6A is a graph of design curves according to the present invention shown 5 with simulated maximum phase shift results for a circuit whose substrate has an effective dielectric constant or $\in_r=2$ and BST tan $\delta=10^{-2}$ at 10 GHz.
Figure 6B:
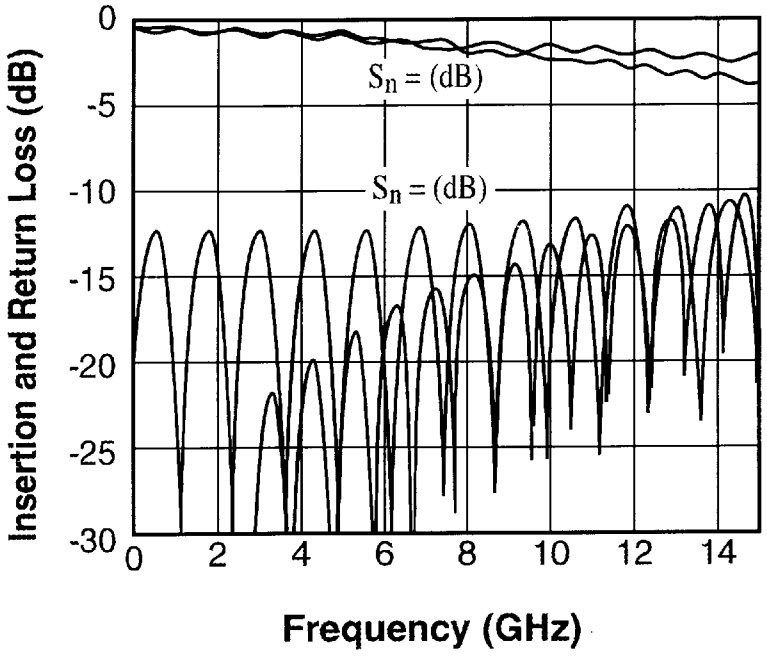
FIG. 6B is a graph of design curves according to the present invention shown with simulated insertion loss and return loss results for a circuit whose substrate has an effective dielectric constant $\in_r=2$ and BST tan $\delta=10^{-2}$ at 10 GHz.

To verify calculations, various detailed simulations of proposed periodically loaded phase shifter circuits were conducted on Hewlett Packard® high frequency circuit simulation software. These simulations reinforced predictions based upon the invention that an optimum loading value exists for minimizing circuit losses, as reflected in FIG. 5. The simulated performance of a phase shifter capable of creating 360° of phase shift at 10 GHz is shown in FIG. 6A and FIG. 6B. The simulation assumes an effective dielectric constant $\in_r$=2 and a BST loss tangent of $10^{-2}$ at 10 GHz. It can be seen that by using the topology proposed herein it is possible to fabricate a 360° phase shifter with an insertion loss of only 2 dB at 10 GHz.

While the inductor circuit within the transmission line has thus far been described as a monolithic transmission-line structure, such as a coplanar waveguide or microstrip, it will be appreciated that other configurations will produce equivalent electrical characteristics. For example, the transmission line inductor 18 of FIG. 1A may be implemented as an interconnected series of periodically distributed lumped-element inductors. The unit cell for a distributed-circuit phase shifter is shown in FIG. 1B as the combination of inductor 20 along with parasitic capacitance 22.

By way of example and not of limitation, these distributed lumped-element inductors may be implemented as planar spiral inductors, or as discrete surface-mounted coil inductors. Lumped-element inductors may be implemented in a variety of forms and integrated with microstrip, coplanar waveguide, and numerous other planar transmission-lines to realize a lumped inductance. The number of turns and turn geometries determine the inductance of the coil.

Figure 7:
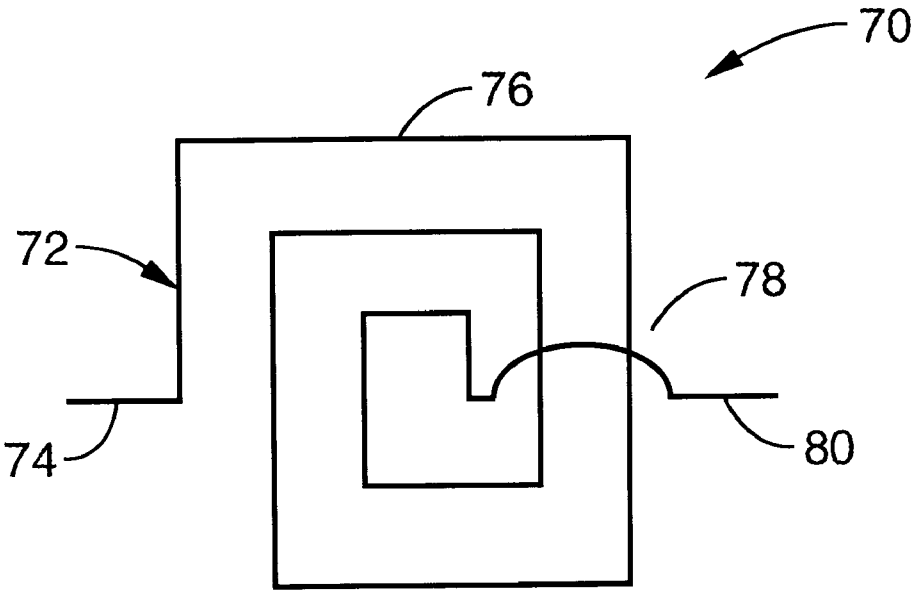
FIG. 7 is a schematic plan view of a planar spiral inductor utilized according to one aspect of the present invention to exemplify a lumped-inductor phase-shifting transmission line.

Referring now to FIG. 7, a lumped-element inductor is shown in the form of a square planar spiral inductor 70 is shown. The embodiment of inductor 70 shown in FIG. 7 comprises a trace 72 that has a first terminal 74 a spiraling trace 76 which is connected by an air bridge 78 to a second terminal 80. Because lumped-element inductors exhibit parasitic capacitance in a similar manner as transmission-lines, along with similar ohmic loss constraints, the optimization procedure is formally equivalent to the transmission-line implementation. However, use of the lumped-element approach provides advantageous circuit size reduction which is especially well suited for use with low-frequency phase shifters having transmission-line lengths that may otherwise be so large as to be impractical.

Figure 8:
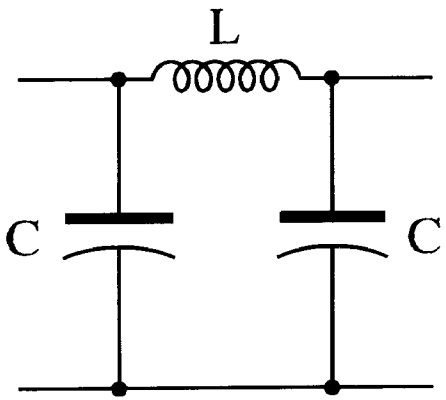
FIG. 8 is a schematic diagram of an equivalent circuit for the lumped-inductor phase-shifter according to an embodiment of the present invention.

FIG. 8 is an equivalent circuit for the lumped-inductor phase shifter circuit which exhibits parasitic capacitance between the loops and ground lead, and therefore is formally equivalent to a loaded transmission-line.

Accordingly, it will be seen that this invention provides a new phase shifter technology for phased antenna arrays, and the like, wherein BST capacitors are used to periodically load the transmission line within the phase shifter. The BST capacitors may be easily incorporated on a substrate layer, for instance by depositing a layer with RF sputtering. This is in sharp contrast to continuously loading the transmission line as in currently done. The present invention provides for optimization of the amount of capacitive loading to minimize circuit loss, as well as the ability to fabricate circuits on different microwave substrates to meet different application specific requirements. These features result in phase shifter circuits with superior performance in relation to ferrite phase shifters, semiconductor phase shifters, and even continuously loaded ferroelectric phase shifters. The advantages of phase shifter circuits implemented according to the present invention include low insertion loss, fast switching speed, the ability to tailor control voltages for specific applications, high power handing capability, low DC power consumption, and low cost due to inexpensive deposition of thin film BST and the ability to use low-cost high-volume circuit fabrication techniques currently utilized for the manufacture of integrated circuits.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A phase shifter, comprising:

(a) a transmission line; and (b) a plurality of barium strontium titanate capacitors periodically loading said transmission line;

(c) wherein said capacitors share a common bias connection;

(d) wherein said capacitors have a capacitance that is dependent upon applied bias voltage; and (e) wherein the resultant loaded transmission line has a phase velocity that may be varied in response to the applied bias voltage.

2. A phase shifter as recited in claim 1, wherein said transmission line is fabricated on a substrate and wherein said capacitors are incorporated into said transmission line as a layer on said substrate.

3. A phase shifter as recited in claim 2, wherein said substrate is selected from the group of substrates consisting of high resistivity silicon, semi-insulating gallium arsenide, alumina, glass, sapphire and magnesium oxide.

4. A phase shifter as recited in claim 2, wherein said capacitors are formed by RF sputtering barium strontium titanate on said substrate.

5. A phase shifter as recited in claim 1, wherein said capacitors comprise parallel plate capacitors.

6. A phase shifter as recited in claim 1, wherein said capacitors comprise interdigitated capacitors.

7. A phase shifter as recited in claim 1, wherein the transmission line comprises a plurality of periodically-spaced series-connected lumped-element inductors.

8. A phase shifter as recited in claim 7, wherein the lumped-element inductors comprise planar spiral inductors.

9. A phase shifter, comprising:

(a) a coplanar waveguide; and (b) a plurality of barium strontium titanate capacitors periodically loading said waveguide;

(c) wherein said capacitors share a common bias connection;

(d) wherein said capacitors have a capacitance that is dependent upon applied bias voltage; and (e) wherein the resultant loaded transmission line has a phase velocity that may be varied in response to the applied bias voltage.

10. A phase shifter as recited in claim 9, wherein said waveguide is fabricated on a substrate into which said capacitors are incorporated as a layer on said substrate.

11. A phase shifter as recited in claim 10, wherein said substrate is selected from the group of substrates consisting of high resistivity silicon, semi-insulating gallium arsenide, alumina, glass, sapphire and magnesium oxide.

12. A phase shifter as recited in claim 10, wherein said capacitors are formed by RF sputtering barium strontium titanate on said substrate.

13. A phase shifter as recited in claim 9, wherein said capacitors comprise parallel plate capacitors.

14. A phase shifter as recited in claim 9, wherein said capacitors comprise interdigitated capacitors.

15. A phase shifter as recited in claim 9, wherein the transmission line comprises periodically-spaced series-connected lumped-element inductors.

16. A phase shifter as recited in claim 15, wherein the lumped-element inductors comprise planar spiral inductors.

17. A phase shifter circuit utilizing traveling waves, comprising a microwave transmission line fabricated on a substrate, and a plurality of barium strontium titanate capacitors positioned periodically along, and loading, said transmission line;

wherein said capacitors share a common bias connection, wherein said capacitors have a capacitance that Is dependent upon applied bias voltage, and wherein the resultant loaded transmission line has a phase velocity that may be varied in response to the applied bias voltage.

18. A phase shifter as recited in claim 17, wherein said capacitors are incorporated as a layer on said substrate.

19. A phase shifter as recited in claim 17, wherein said substrate is selected from the group of substrates consisting of high resistivity silicon, semi-insulating gallium arsenide, alumina, glass, sapphire and magnesium oxide.

20. A phase shifter as recited in claim 17, wherein said capacitors are formed by RF sputtering barium strontium titanate on said substrate.

21. A phase shifter as recited in claim 17, wherein said capacitors comprise parallel plate capacitors.

22. A phase shifter as recited in claim 17, wherein said capacitors comprise interdigitated capacitors.

23. A phase shifter as recited in claim 17, wherein the transmission line comprises periodically-spaced series-connected lumped-element inductors.

24. A phase shifter as recited in claim 23, wherein the lumped-element inductors comprise planar spiral inductors.

* * * * *